US005139071A

United States Patent [19]

Danchulis

[11] Patent Number: 5,139,071

[45] Date of Patent: Aug. 18, 1992

[54] LOUVERED BLIND

[76] Inventor: James E. Danchulis, 244 Sunset Dr., Pittsburgh, Pa. 15235

[21] Appl. No.: 739,934

[22] Filed: Aug. 2, 1991

[51] Int. Cl.[5] ..... E06B 3/48

[52] U.S. Cl. ..... 160/115; 160/900; 160/176.1

[58] Field of Search ..... 160/115, 113, 176.1, 160/168.1, 178.1, 900

[56] References Cited

U.S. PATENT DOCUMENTS

| | | |
|---|---|---|
| 283,941 | 8/1883 | Williams . |
| 504,533 | 9/1893 | Lunken . |
| 1,095,292 | 5/1914 | Smith . |
| 2,565,217 | 8/1951 | Frank . |
| 4,621,672 | 11/1986 | Hsu . |
| 4,657,061 | 4/1987 | Meier . |

*Primary Examiner*—Blair M. Johnson

*Attorney, Agent, or Firm*—Arnold B. Silverman; David V. Radack

[57] ABSTRACT

A louvered blind having a first blind assembly defining a first passageway and a second blind assembly defining a second passageway. A rod passes through both the first and second passageways. A first spacer is frictionally secured to the rod and has a portion disposed in the first passageway for securing the rod to the first blind assembly. The rod is fixedly secured to the second blind. The louvered blind also includes a mechanism for rotating the first spacer and a stop mechanism operatively associated with the rod to resist rotation of the rod. In use, the first spacer and the first blind assembly can be rotated simultaneously with the rod and the second blind assembly. The spacer and the first blind can also be rotated when the stop mechanism resists rotation of the rod and the second blind assembly so that the first blind assembly can be rotated independently of the second blind assembly.

22 Claims, 5 Drawing Sheets

LOUVERED BLIND

BACKGROUND OF THE INVENTION

1. Field Of The Invention

This invention relates to a louvered blind and more particularly to a louvered blind having at least two separate blind members which can be rotated simultaneously or independent of each other.

2. Background Information

Vertical louvered blind systems comprising a multiplicity of vertical individual louvered blinds have been used to cover windows, doors and other openings so as to provide privacy and control of the entry of light. The individual louvered blinds are attached to a truck which contains a mechanism for rotating the louvered blind. The truck is hung on a horizontal support system along with the other trucks that contain the other louvered blinds. The louvered blinds can be rotated into a closed or open position or can be moved to one side of the window or other opening so that the window or other opening is unobstructed.

A modification of the basic louvered blind system is shown in U.S. Pat. No. 4,657,061. This patent discloses vertically discontinuous blinds. Each blind is mounted on a separate tube. The separate tubes are assembled concentrically and are secured to separate worm gear mechanisms. A separate beaded chain loop is provided for each of the worm gear mechanisms so as to control rotation of each blind.

The system disclosed in U.S. Pat. No. 4,657,061 requires several different parts to effect the desired result of independently rotatable vertical blind elements. This not only increases the manufacturing cost of the system but also increases the overall weight of the louvered blind system. Furthermore, very exact manufacturing tolerances are required to assure that the system will function properly. Finally, as there are three separate chains to control the movement of each blind, it can be a frustrating experience for a user to obtain the desired positions for the individual blinds.

U.S. Pat. No. 4,621,672 discloses a mechanism for a window blind having two sets of horizontal slats which are movable independent of each other. The mechanism includes four rollers which are mounted on two rotatable shafts. The shafts are rotated by providing a worm gear engagement.

U.S. Pat. No. 2,565,217 discloses a venetian blind having a series of groupings of slats. One set of groupings can be separately opened and closed by pull ropes. Another set of groupings can be rotated by means of a pin fastened to and projecting from a stub shaft. A main pull rope is also provided to open or close all of the slats in unison.

Despite these and other louvered blind systems, there still remains a need for a louvered blind with independently rotating sections that contains a minimum of operable parts. The louvered blind should be easily and efficiently manufactured. Finally, there is a need for a louvered blind with independently rotating sections that is easy to install and simple to operate.

SUMMARY OF THE INVENTION

The louvered blind of the invention has met the needs set forth hereinbefore. The louvered blind includes a first blind assembly defining a first passageway and a second blind assembly defining a second passageway. A rod passes through both the first and second passageways. A first spacer is frictionally secured to the rod and has a portion disposed in the first passageway for securing the rod to the first blind assembly. The rod is fixedly secured to the second blind assembly. The louvered blind also includes a mechanism for rotating the first spacer and a stop mechanism operatively associated with the rod to resist rotation of the rod.

The first blind assembly and the second blind assembly can be rotated simultaneously with the rod so that both first and second blind assemblies can be oriented in a similar angular relationship. The invention also provides that the first spacer and the first blind assembly can be rotated when the stop mechanism resists rotation of the rod means and the second blind assembly. This allows for the first and second blind assemblies to be oriented in different angular relationships with respect to each other. Furthermore, after establishing differing angular relationships with respect to each other, the first and second blind assemblies can again be rotated simultaneously so that the position of the entire louvered blind with respect to the window or other opening that the louvered blind is associated with can be changed.

It is an object of the invention to provide a louvered blind having vertically discontinuous blind elements.

It is a further object of the invention to provide that the first blind assemblies can rotate independently of the second blind assemblies such that the first and second blind assemblies can be oriented in different angular relationships with respect to each other.

It is a further object of the invention to provide a louvered blind which is efficiently and inexpensively manufactured.

It is a further object of the invention to limit the number of operable parts in a vertically discontinuous blind.

It is a further object of the invention to provide a louvered blind that is easy to use.

These and other objects of the invention will be fully understood from the following description of the invention with reference to the drawings appended to this application.

DESCRIPTION OF THE PREFERRED EMBODIMENTS

Figure 1:
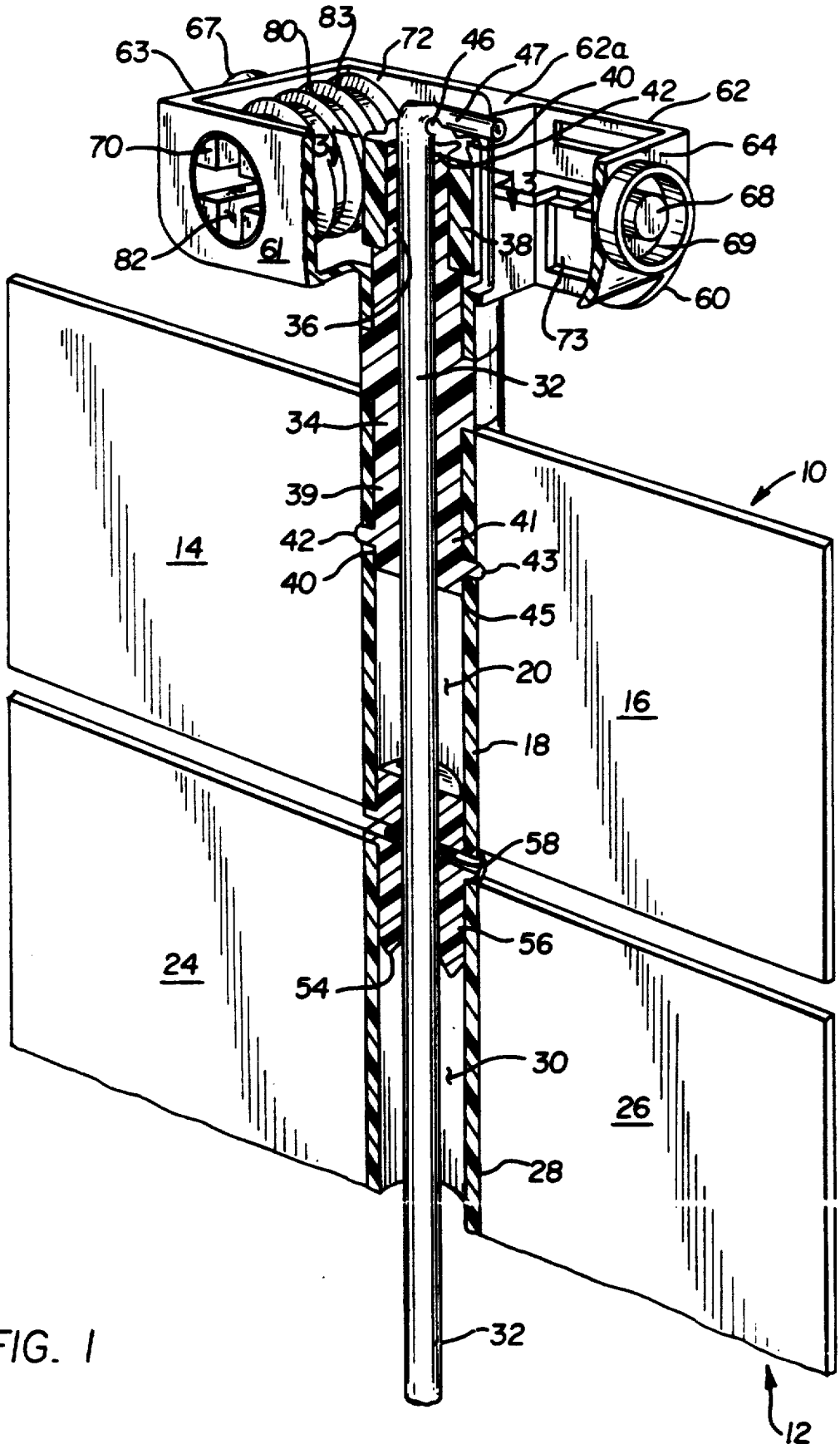
FIG. 1 is a perspective view, partially in section, of the louvered blind of the invention.
Figure 2:
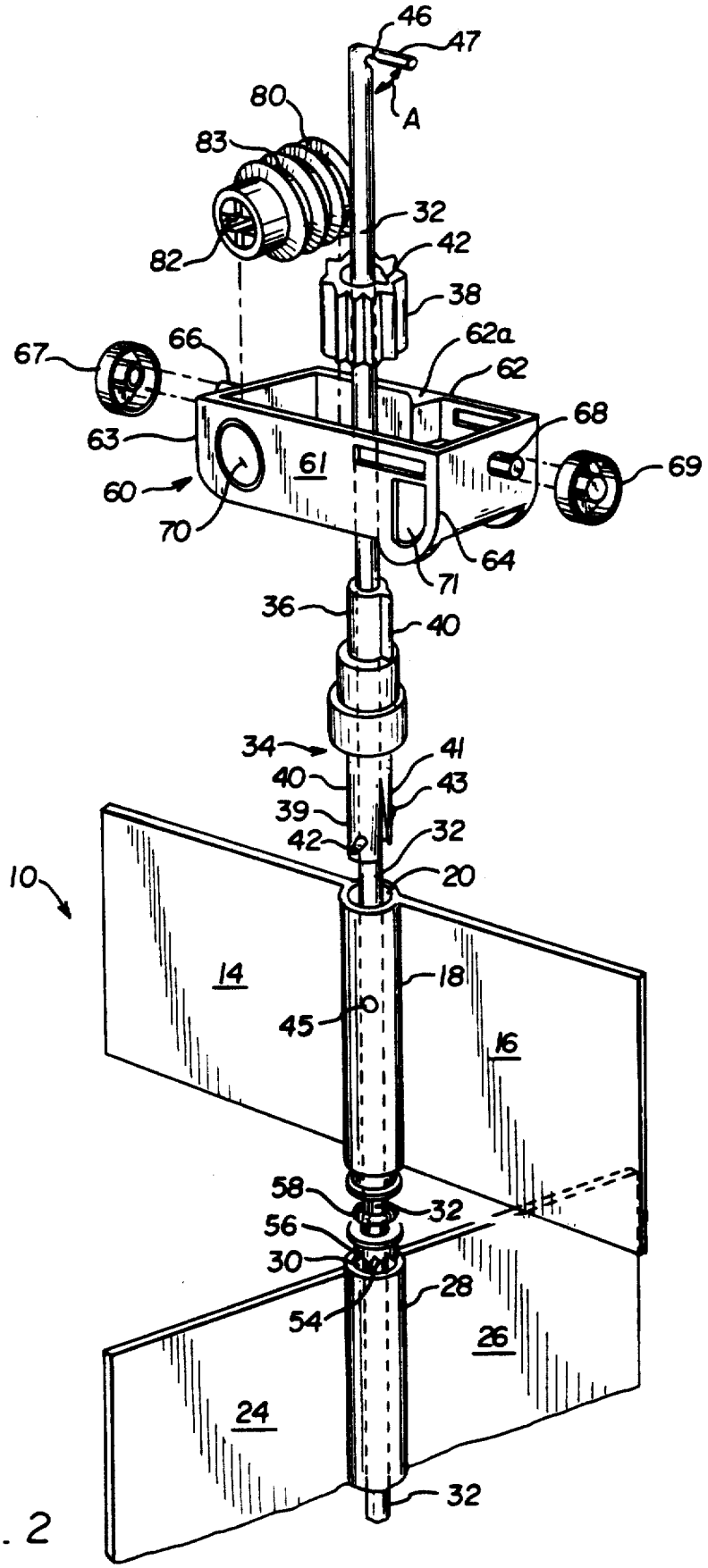
FIG. 2 is a exploded perspective view of the louvered blind of the invention.
Figures 3, 4:
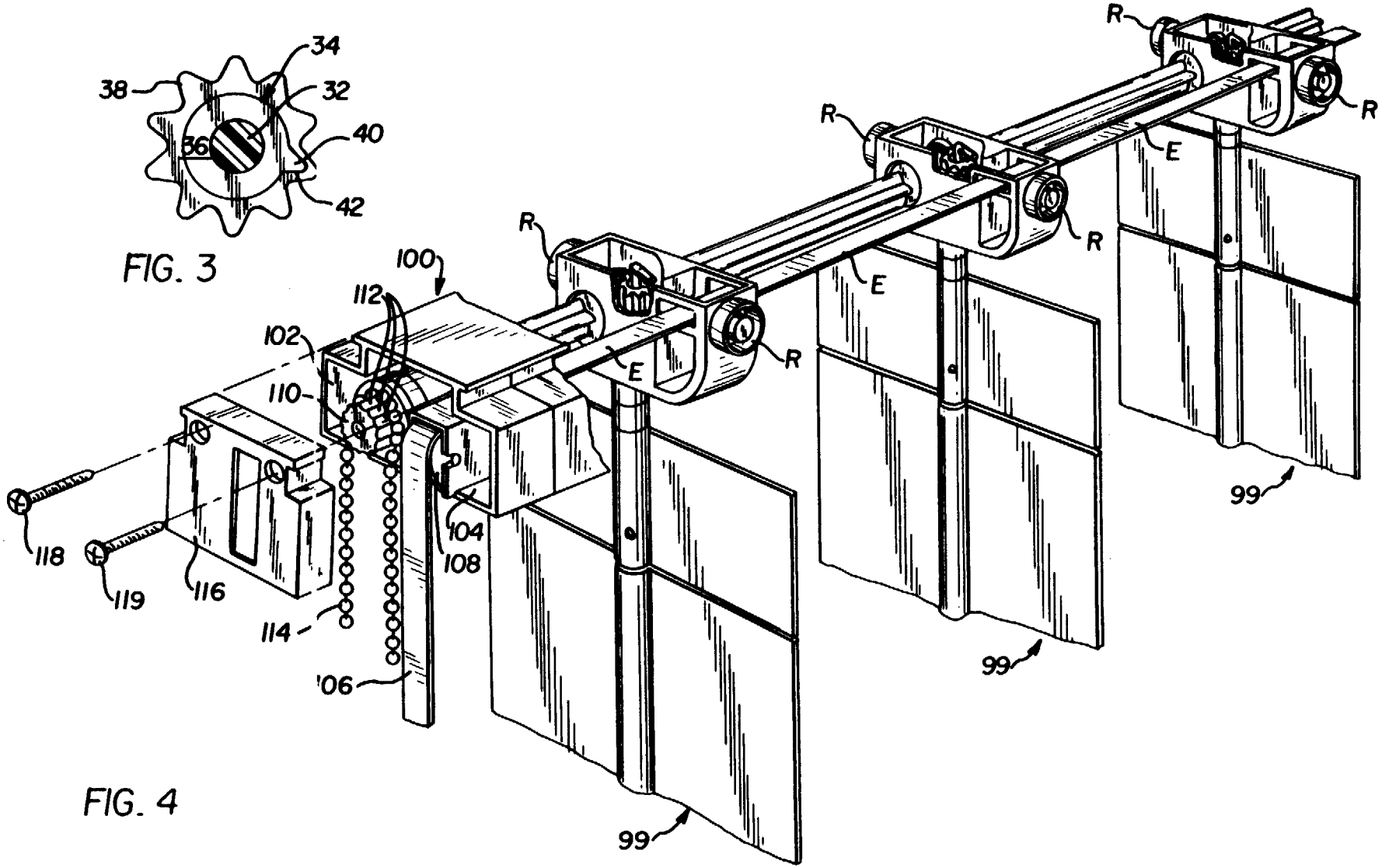
FIG. 3 is a cross-sectional view taken along line 3—3 of FIG. 1.
FIG. 4 is a perspective view, partially in section, of a plurality of louvered blinds of the invention mounted in a horizontal support system.

Referring to FIGS. 1-3, the louvered blind of the invention will be described. The louvered blind consists of a top blind 10 and a bottom blind 12. The top blind 10 has a left section 14 and right section 16. Left section 14, right section 16 and extrusion 18 can be extruded as an integral one-piece assembly. Alternatively, the assembly could be a semi-hollow extrusion with an additional extrusion snapping into the semi-hollow extrusion as will be explained below with respect to FIGS. 6 and 7. The sections 14 and 16 are attached to an extrusion 18 which defines a passageway 20. The sections 14 and 16, along with extrusion 18, can be made of materials selected from the group consisting of plastics, aluminum, wood and fabric and combinations thereof. The sections 14 and 16 can be attached to the extrusion 18 in several different ways as will be shown in FIGS. 5-9. Similarly, bottom blind 12 has a left section 24 and a right section 26. The sections 24 and 26 are attached to a plastic extrusion 28 which defines a passageway 30. The sections 24 and 26 can be attached to the extrusion 28 in several different ways as will be shown in FIGS. 5-9.

It will be appreciated that for design and aesthetic purposes, the materials used for sections 14 and 16 can be the same as or different from the materials used for sections 24 and 26. In addition, the materials used can have different colors and textures.

As can best be seen in FIG. 2, a rod 32 is passed through the passageways 20 and 30. Disposed near the top end of the rod 32 is a spacer means 34 which is frictionally attached to the rod 32. The spacer means 34 is frictionally attached to the rod 32 so that (i) spacer means 34 and rod 32 can axially rotate simultaneously and (ii) spacer means 34 can axially rotate while rod 32 is resisted from rotating.

The spacer means 34 has a top portion 36 around which is mounted a gear 38 and bottom portion 39 which is attached to extrusion 18 of the top blind 10. As can best be seen in FIG. 3, top portion 36 of the spacer means 34 includes a key 40 which engages a key way 42 in gear 38 so as to facilitate mounting of gear 38 onto the rod 32. The gear 38 is adapted to engage a worm gear, as will be explained hereinafter.

The bottom portion 39 is split into two prongs 40 and 41. The prongs 40 and 41 have protrusions 42 and 43 which extend from the surface of the prongs 40 and 41. The protrusions 42 and 43 are adapted to engage holes 44 and 45 in extrusion 18 in order to secure the spacer means 34 to the extrusion 18 and thus connect the rod 32 to the top blind 10.

The top portion of rod 32 includes a living hinge 46 which is connected to an extending finger 47. The living hinge 46 is in the form of a circular cutout which will facilitate the movement of finger 46 in the directions shown by the arrow "A" in FIG. 2. As can be seen in FIG. 1, the finger 47 is adapted to form a right angle with the rod 32. The finger 47 is part of the stop means of the invention and its operation will be explained further hereinafter. The finger 47 is retractable so that the rod 32 can be inserted up through passageways 30 and 20 of the bottom blind extrusion 28 and the top blind extrusion 18, respectively. If desired, a separate section can be attached to the top of the rod which contains the finger and the living hinge.

The bottom blind 12 is fixedly secured to the rod 32 by means of a spring nut 54. Alternate means of fixedly securing the rod 32 to the bottom blind 12 are gluing or using a set screw or allen head screw. As is known, the spring nut 54 will expand and bite into the plastic extrusion 28 to fixedly secure the rod 32 to the bottom blind 12. A spacer 56, which is attached to the rod 32, is inserted in the passageway 30. An 0-ring 58 is placed on top of the spacer 36 and engages the top and bottom blinds 10 and 12. The 0-ring 58 keeps the bottom blind 12 firmly attached to the rod 32.

The louvered blind includes a housing 60, commonly referred to in the art as a truck, which houses the top portion of the rod 32. The truck 60 has a front wall 61, backwall 62 and two sidewalls 63 and 64. Backwall 62 includes an inwardly projecting protrusion 62*a*. Rotatably mounted to an axle 66 on the sidewall 63 is a roller 67 and rotatably mounted to an axle 68 on the sidewall is a roller 69. These rollers 67 and 69 are adapted to be mounted in a horizontal support system as will be shown in FIG. 4.

The front wall 61 of the truck 60 defines two openings 70 and 71 (FIG. 2) and the backwall 62 defines two similar openings 72 and 73 (FIG. 1). Mounted in between openings 70 and 72 is a worm gear 80. The worm gear 80 defines a cross-shaped opening 82, which will facilitate placement of a shaft (not shown in these figures) for rotating the worm gear 80. The worm gear 80 contains helical teeth 83 which will engage the teeth of gear 38 in order to rotate rod 32.

The louvered blind operates as follows. A shaft (not shown in these figures) is placed in the cross-shaped opening 82 of the worm gear 80. The shaft has longitudinal ribs which define recesses, which are adapted to be engaged by the ribs in the cross-shaped opening 82. The shaft is turned so that the worm gear 80 rotates. The worm gear 80 teeth 83 intermesh with the teeth on gear 38, thus rotating gear 38. As can be seen in FIG. 1, gear 38 which is frictionally attached to spacer means 34, rotates the spacer means 34 and thus the rod 32. Because the rod 32 is attached to both top blind 10 and bottom blind 12, both of these blinds 10 and 12 are rotated in the direction of the rotation of the rod 32.

As will be appreciated, the range of rotation of the rod 32 is dependent on the (i) the length of finger 47 and (ii) the positioning of walls 61 and 62 relative to the finger 47. The front wall 61 or backwall 62 will be engaged by the finger 47 to resist rotation of the rod 32. As shown in FIGS. 1 and 2, the finger 47 can also engage a protrusion 62*a* in the truck 60 to further control rotation. In operation, the finger 47 will engage the walls 61 and 62 to prevent rotation of the rod 32. As blind 12 is fixedly secured to the rod 32, when rod 32 is unable to rotate, blind 12 will also be unable to rotate. However, because first spacer means 34 is frictionally secured to the rod 32, gear 38 can continue to be rotated by the worm gear 80 even after the finger 47 prevents rod 32 from rotating. In this way, the spacer means 34 will continue to rotate the top blind 10 while the bottom blind 12 is fixed in one place.

It will also be appreciated that the shaft (not shown) can be rotated in the opposite direction, thus reversing the rotation of worm gear 80. In this way, the finger 47 no longer resists the rotation of rod 32, so rod 32 and thus the lower blind 12 are free to rotate in unison with the top blind 10. Thus, a particular angular relationship can be established between the top and bottom blinds 10 and 12 (such as is shown in FIG. 2, with top blind assembly 10 at an angle of about 90° relative to bottom blind assembly 12) and then the top and bottom blinds 10 and 12 can be rotated in unison to control the relationship of the louvered blind to the window or door on which it is mounted.

It will be appreciated that the louvered blind of the invention provides a top and bottom blind that can be positioned in an infinite number of angular relationships to each other and to the window with which it is associated. The louvered blind is easy to manufacture and use and requires far less parts than do prior art designs.

Referring now to FIG. 4, a plurality of louvered blinds 99 of the invention are shown mounted in a conventional horizontal support system 100. The horizontal support system 100 which includes a first parallel runway track 102 and a second parallel runway track 104 in which the rollers "R" (such as rollers 67 and 69 of the louvered blind of FIGS. 1-2) of the louvered blinds are mounted. Conventional equalizers "E" are mounted in the horizontal support system in order to maintain substantially equal distances between the individual vertical louvered blinds and to also provide a means of drawing the individual vertical louvered blinds away from the opening or window to which the support system 100 is mounted. The blinds are drawn open and shut in the conventional manner by means of rope 106 which is mounted on pulley 108.

An elongated shaft 110 is provided which is passed through the cross-shaped openings, such as 82 in louvered blind "B" shown in FIGS. 1 and 2, of all louvered blinds in order to control the rotation of the separate top and bottom blinds of the louvered blind construction. The shaft 110 is provided with several longitudinal recesses 112 which are adapted to be engaged by a beaded chain 114 to facilitate rotation of the shaft 110 whereby orbital movement of the chain 114 creates responsive axial rotation of the shaft 110. The end of the support system 100 is provided with a cover 116 which is fastened to the remainder of the support system by screws 118 and 119.

It will be appreciated that the blinds can be made of different materials and different colors. In addition, murals and pictures can be painted on the blinds to create a louvered blind system which also functions as a piece of artwork. The top blinds and bottom blinds can be made into different shapes, so that, for example, the top blinds form a crescent and the bottom blinds form a parabolic shape. The combinations of shapes, materials and colors are endless and can all be utilized with the louvered blind of the invention.

Figure 5:
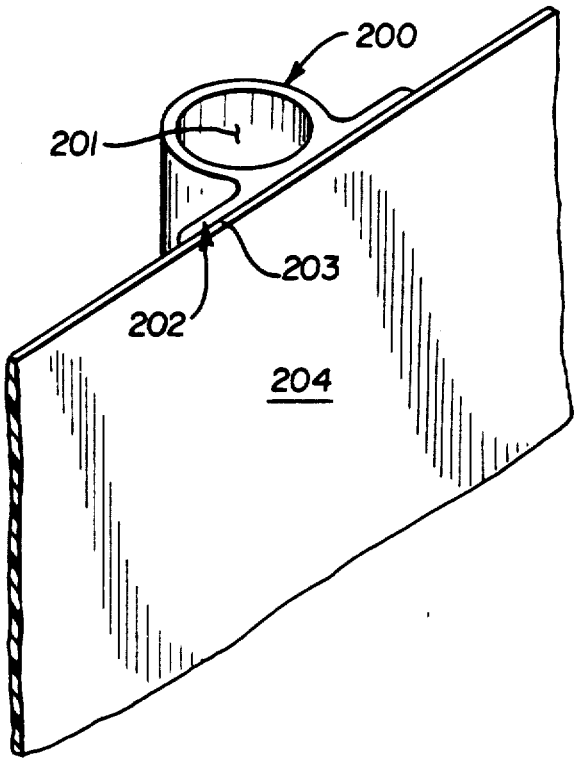
FIG. 5 is a perspective view of the blind assembly showing the extrusion and blind material attached thereto.

Referring to FIGS. 5-9, there is shown some of the methods of forming the extrusion and the section and sections of materials used for the blinds. FIG. 5 shows an extrusion 200 forming a passageway 201. The extrusion 200 has a flange 202 having a flat surface 203 upon which the material 204 of the blind is secured The material 204 can be secured by gluing or other adhesive means as well as by mechanical means. In this embodiment, only one section of material is used to form the entire blind.

Figure 6:
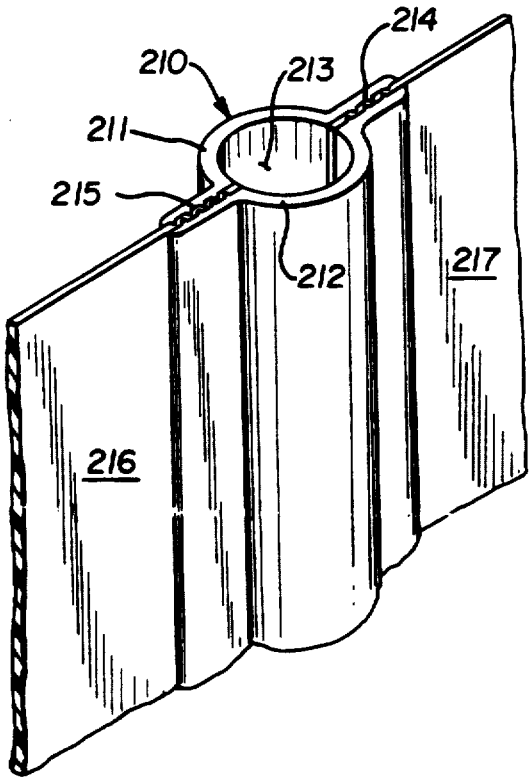
FIG. 6 is another embodiment of the blind assembly.

FIG. 6 shows a two piece extrusion 210, having a first portion 211 and a second portion 212 which together define a passageway 213 and two slots 214 and 215. Disposed in the slots 214 and 215 are sections 216 and 217 of material which together constitute the blind. As with the material 204 in the embodiment of FIG. 5, this material can be secured by gluing, adhesives or mechanical means.

Figure 7:
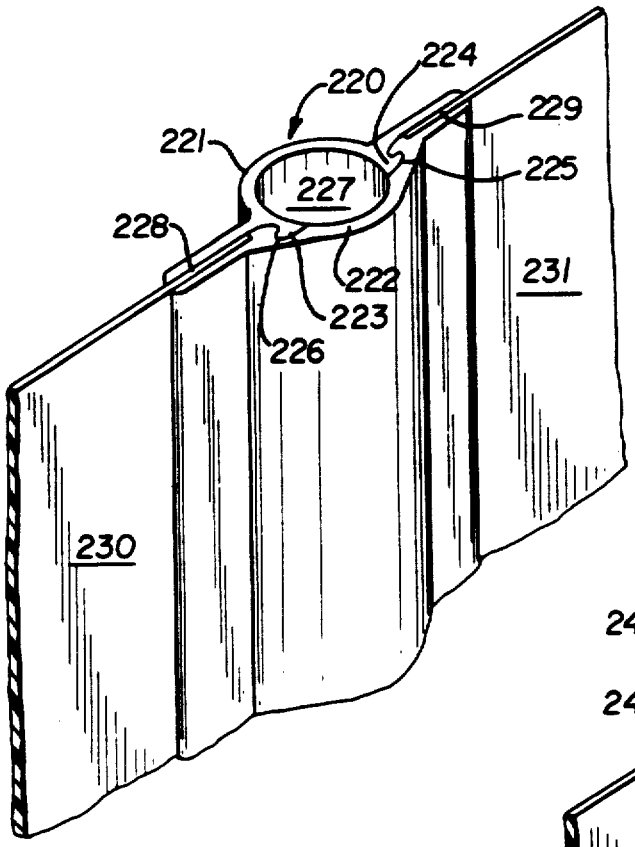
FIG. 7 is yet another embodiment of the blind assembly.

FIG. 7 shows an extrusion 220 having first and second interlocking sections 221 and 222. First section 221 has extending tongue portions 223 and 224 which engage in respective groove portions 225 and 226 of second section 222. The first and second sections 221 and 222 define a passageway 227 and slots 228 and 229. Disposed in the slots 228 and 229 are sections of material 230 and 231 which together constitute the entire blind.

Figure 8:
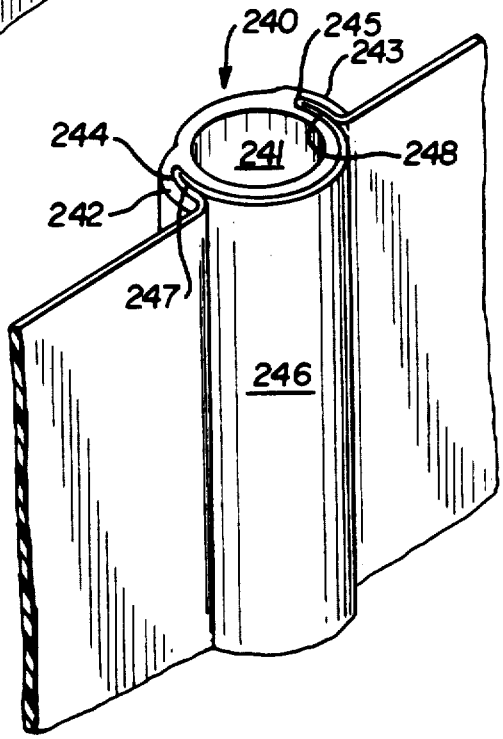
FIG. 8 is still yet another embodiment of the blind assembly.

FIG. 8 shows a one piece extrusion 240 defining passageway 241 and having fingers 242 and 243 which define slots 244 and 245. Only one section of material 246 is used by creating two folds 247 and 248 in the material and then inserting the folds 247 and 248 into respective slots 244 and 245.

Figure 9:
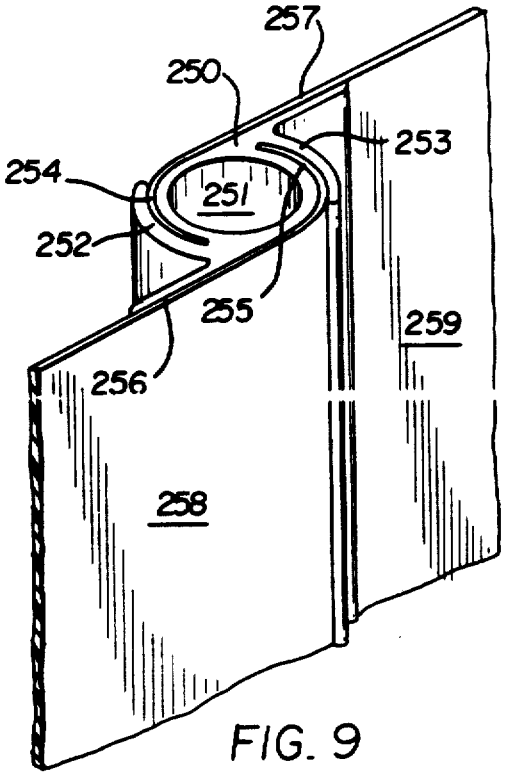
FIG. 9 is still yet another embodiment of the blind assembly.

FIG. 9 also shows a one piece extrusion 250 defining passageway 251 which has fingers 252 and 253 which define slots 254 and 255. Extrusion 250 also includes flanges 256 and 257. Two sections of material 258 and 259 are used to make up the entire blind, with material 258 being placed in slot 255 and material 259 being placed in slot 254.

It will be appreciated that a louvered blind having at least two separate blind members which can be rotated simultaneously or independent of each other are provided. A plurality of louvered blinds can be mounted in a horizontal support system to cover a window or a door opening. A number of different extrusions to which the material of the blinds are fastened are also provided.

Whereas a particular embodiment of the invention has been described hereinabove, for purposes of illustration, it would be evident to those skilled in the art that numerous variations of the details may be made without departing from the invention as defined in the appended claims.

What is claimed is:

1. A louvered blind comprising:

a first blind assembly defining a first passageway;

a second blind assembly defining a second passageway;

rod means passing through both said first and second passageways;

first spacer means frictionally secured to said rod means;

said first spacer means having a portion disposed in said first passageway for securing said rod means to said first blind assembly;

means for fixedly securing said rod means to said second blind assembly;

means operatively associated with said first spacer means for rotating said first spacer means; and stop means for resisting rotation of said rod means, whereby (i) said first spacer means and said first blind assembly can be rotated simultaneously with said rod means and said second blind assembly and (ii) said first spacer means and said first blind assembly can be rotated when said stop means resists rotation of said rod means and said second blind assembly so that said first blind assembly can be rotated independently of said second blind assembly.

2. The louvered blind of claim 1, including a housing in which said rotation means is mounted.

3. The louvered blind of claim 2, wherein said stop means includes mechanical means for interfering with the rotational movement of said rod means.

4. The louvered blind of claim 3, wherein said mechanical means includes a protrusion on said rod means adapted at a certain point in the rotational movement of said rod means to engage said housing and thereby resist rotation of said rod means.

5. The louvered blind of claim 4, wherein said protrusion is attached to said rod means by hinge means.

6. The louvered blind of claim 1, wherein said means for fixedly securing said rod means to said second blind is a spring nut attached to said rod means.

7. The louvered blind of claim 1, wherein said rotating means includes (i) a gear mounted on said first spacer means and (ii) a worm gear intermeshed with said gear, whereby rotation of said worm gear will establish responsive rotation of said gear and said first spacer means.

8. The louvered blind of claim 7, wherein said first spacer means has a key and said gear defines a keyway for receiving said key, whereby mounting of said first spacer means to said gear is facilitated.

9. The louvered blind of claim 8, including said worm gear defining an interior shaft receiving opening; and a shaft disposed in said interior shaft receiving opening and mechanically interengaged with said worm gear for facilitating responsive rotation of said worm gear.

10. The louvered blind of claim 9, wherein said shaft has a plurality of longitudinally oriented ribs which define recesses.

11. The louvered blind of claim 10, including chain means engaging in said recesses, whereby orbital movement of said chain means creates responsive axial rotation of said shaft.

12. The louvered blind of claim 1, wherein said portion of said first spacer means which secures said first blind assembly includes two resilient prongs.

13. The louvered blind of claim 12, wherein said prongs each have protrusions, said first passageway defining holes, and said protrusions engage said holes to secure said first spacer means to said first blind assembly.

14. The louvered blind of claim 1, wherein said first and second blind assemblies each include (i) an extrusion defining said first and second passageways and (ii) a blind material fixedly attached to said extrusion.

15. The louvered blind of claim 14, wherein said blind material includes a first section attached to one side of said extrusion and a second section attached to the other side of said extrusion.

16. The louvered blind of claim 15, wherein said extrusion includes a first section and a second section with said blind material being disposed therebetween.

17. The louvered blind of claim 16, wherein said first section and said second section are mechanically interlocked.

18. A louvered blind assembly comprising:

horizontal support means;

at least one louvered blind mounted in said horizontal support means, said louvered blind including:

a first blind assembly defining a first passageway;

a second blind assembly defining a second passageway;

rod means passing through both said first and second passageways;

first spacer means frictionally secured to said rod means;

said first spacer means having a portion disposed in said first passageway for securing said rod means to said first blind assembly;

means for fixedly securing said rod means to said second blind assembly;

means operatively associated with said first spacer means for rotating said first spacer means;

a housing in which said rotating means is mounted, said housing having at least one opening; and stop means for resisting rotation of said rod means, whereby (i) said first spacer means and said first blind assembly can be rotated simultaneously with said rod means and said second blind assembly and (ii) said first spacer means and said first blind assembly can be rotated when said stop means resists rotation of said rod means and said second blind assembly so that said first blind assembly can be rotated independently of said second blind; and means for joining said louvered blinds, said joining means passing through said openings in said housing and being mounted in said horizontal support means.

19. The louvered blind of claim 18, wherein said rotating means includes (i) a gear mounted on said first spacer means and (ii) a worm gear intermeshed with said gear, whereby rotation of said worm gear will establish responsive rotation of said gear and said first spacer means.

20. The louvered blind of claim 19, including said worm gear defining an interior shaft receiving opening; and an elongated shaft passing through each of said shaft openings and mechanically interengaged with said worm gear for facilitating responsive rotation of each of said worm gears.

21. The louvered blind of claim 20, wherein said shaft has a plurality of longitudinally oriented ribs which define recesses.

22. The louvered blind of claim 21, including chain means engaging in said recesses, whereby orbital movement of said chain means creates responsive axial rotation of said elongated shaft.

* * * * *